US006768880B2

(12) United States Patent
Iida et al.

(10) Patent No.: US 6,768,880 B2
(45) Date of Patent: Jul. 27, 2004

(54) IMAGE FORMING APPARATUS

(75) Inventors: Kazuhiko Iida, Nagano (JP); Toshiya Takahata, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/324,121

(22) Filed: Dec. 20, 2002

(65) Prior Publication Data

US 2003/0138262 A1 Jul. 24, 2003

(30) Foreign Application Priority Data

Dec. 20, 2001 (JP) ..... P2001-386970
Jun. 3, 2002 (JP) ..... P2002-161957

(51) Int. Cl.[7] ..... G03G 15/06
(52) U.S. Cl. ..... 399/55; 399/223
(58) Field of Search ..... 399/38, 53, 54, 399/55, 222, 223, 234, 235

(56) References Cited

U.S. PATENT DOCUMENTS 6,330,405 B1 * 12/2001 Ishii et al. ..... 399/55
2002/0003967 A1 * 1/2002 Okada ..... 399/55

FOREIGN PATENT DOCUMENTS

EP 0547 348 A2 6/1993
JP 5-307310 11/1993

* cited by examiner

*Primary Examiner*—Hoan Tran
(74) *Attorney, Agent, or Firm*—Sughrue Mion, PLLC

(57) ABSTRACT

A latent image is formed on a photoreceptor. Each of a plurality of toner carriers carries toner of a single color to be transferred onto the photoreceptor to make the latent image visible. Each of the toner carriers is fixed at a predetermined distance from a surface of the photoreceptor. A first bias supplier supplies a first bias required to transfer the toner to the photoreceptor to one of the toner carriers which is subjected to a developing operation. A second bias supplier supplies a second bias which is not enough to transfer the toner to the photoreceptor to the other toner carriers which are not subjected to the developing operation.

11 Claims, 4 Drawing Sheets

IMAGE FORMING APPARATUS

BACKGROUND OF THE INVENTION

The present invention relates to a color image forming apparatus on a non-contact developing system.

During the developing process in an image forming apparatus using electrophotography, a photoreceptor such as a photosensitive drum or a photosensitive belt is rotated at a fixed speed in a predetermined direction first and uniformly charged by a charging unit disposed around the photoreceptor. Then the photoreceptor is exposed to a light beam from an exposure unit and scanned, whereby an electrostatic latent image is formed on the photoreceptor. Further, the electrostatic latent image formed on the photoreceptor is developed by developing units (developing devices) disposed around the photoreceptor.

The developing unit is provided with a developing roller (toner carrier) for carrying toner to a developing position opposite to the photoreceptor. The toner from the developing roller is made to stick to the photoreceptor, so that the electrostatic latent image is reduced to a visible image. In the case of a color image forming apparatus, a series of charging, exposure and developing steps is successively repeated on a color basis (e.g., Y (yellow), M (magenta), C (cyan) and K (black)).

A related-art color image forming apparatus is provided with developing rollers for carrying four colors of YMCK in the respective developing units and when these colors are developed, there has been employed a system of moving the developing roller for an applicable color up to a predetermined position to make the developing roller contact or adjoin a photoreceptor. In other words, the operation of moving the developing roller has been needed at each step of developing the applicable color. In case where four color developing rollers are disposed around the axis of rotation on the photoreceptor, for example, the designated developing rollers have been swung one after another to make such a developing roller contact or adjoin the photoreceptor.

However, the aforesaid related-art color image forming apparatus requires a precision transfer mechanism for moving the developing rollers, space and time therefor. Consequently, the adoption of the system of moving the developing rollers on a color basis has constituted obstacles to reducing the cost and size as well as increasing the operating speed of such an apparatus.

As a method of solving the foregoing problems, it is conceivable to fixedly place the four color developing rollers at the predetermined positions around the photoreceptor by adopting a non-contact developing system in order not to necessitate moving the developing rollers. However, there are the following problems for making this method effectual.

A developing gap on the non-contact developing system is provided between developing rollers and a photoreceptor so as to carry out development. However, in case where the gap is too large, neat development is unavailable because toner is insufficiently transferred from the developing roller to the photoreceptor, whereas in case where the gap is too small, the toner is cause to transfer from the developing roller not in operation and there occurs a phenomenon of color mixture. Consequently, the problem is that high-quality development is difficult to carry out on the system.

As four of the developing units are needed to be disposed around the photoreceptor on the system above, the mounting angles of the developing units differ from each other and it is needed to contrive to prevent toner from being left over in a toner container in each developing unit. Moreover, as each developing roller is installed close to the photoreceptor, the developing devices must be arranged so that the photoreceptor is protected from being damaged when they are removed and replaced.

SUMMARY OF THE INVENTION

It is therefore an object of the invention to provide a color image forming apparatus on a non-contact developing system, capable of preventing toner in color being not developed from transferring to a photoreceptor even though the gap between developing rollers and the photoreceptor is decreased, using toner without waste and making developing devices removable and replaceable with safety.

In order to accomplish the object above, according to the invention, there is provided a color image forming apparatus, comprising:

a photoreceptor, on which a latent image is formed;

a plurality of toner carriers, each carries toner of a single color to be transferred onto the photoreceptor to make the latent image visible, each of the toner carriers fixed at a predetermined distance from a surface of the photoreceptor;

a first bias supplier, which supplies a first bias required to transfer the toner to the photoreceptor to one of the toner carriers which is subjected to a developing operation; and a second bias supplier, which supplies a second bias which is not enough to transfer the toner to the photoreceptor to the other toner carriers which are not subjected to the developing operation.

In such an apparatus, even though the distance between the photoreceptor and the toner carriers is decreased, toner color being not developed is prevented from mixing with what is being developed, so that high-quality printing can be done.

Preferably, the first bias includes an AC component and a DC component, and the second bias is the DC component of the first bias.

In order to accomplish the object above, according to the invention, there is also provided a color image forming apparatus, comprising:

a photoreceptor, on which a latent image is formed;

a plurality of toner carriers, each carries toner of a single color to be transferred onto the photoreceptor to make the latent image visible, each of the toner carriers fixed at a predetermined distance from a surface of the photoreceptor;

a first bias supplier, which supplies a first bias having at least one first absolute value required to transfer the toner to the photoreceptor to one of the toner carriers which is subjected to a developing operation; and a second bias supplier, which supplies a second bias having a second absolute value less than the first absolute value to the other toner carriers which are not subjected to the developing operation.

Preferably, the first bias includes an AC component and a DC component having the first absolute value.

Preferably, a plurality of first absolute values are provided according to colors of the toner.

In the above configurations, it is preferable that the toner is stored in a toner container disposed above each of the toner carriers. In this case, even in the system of disposing the toner carriers around the photoreceptor, the toner is never left in the toner containers without being supplied to the photoreceptor, so that the toner can be used up without waste.

In the above configurations, it is preferable that the apparatus further comprises: a plurality of developing devices, each including at least one of the toner carriers, each of the developing devices disposed at an installing position and movable from the installing position in a first direction; and a guide member, which guides each developing device such that a distance between the surface of the photoreceptor and each toner carrier is enlarged in a second direction substantially perpendicular to the first direction, in accordance with a movement of each developing device in the first direction.

Accordingly, the developing devices can be safely removed and replaced without damaging the photoreceptor.

In the above configurations, it is preferable that the photoreceptor is at least one of a plurality of photoreceptors provided in the apparatus.

According to the invention, it is thus possible to realize a high-quality color image forming apparatus on a non-contact developing system and to provide such a color image forming apparatus as is higher in operating speed and lower in cost and size than what utilizes the related-art developing-roller moving system.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Figure 1:
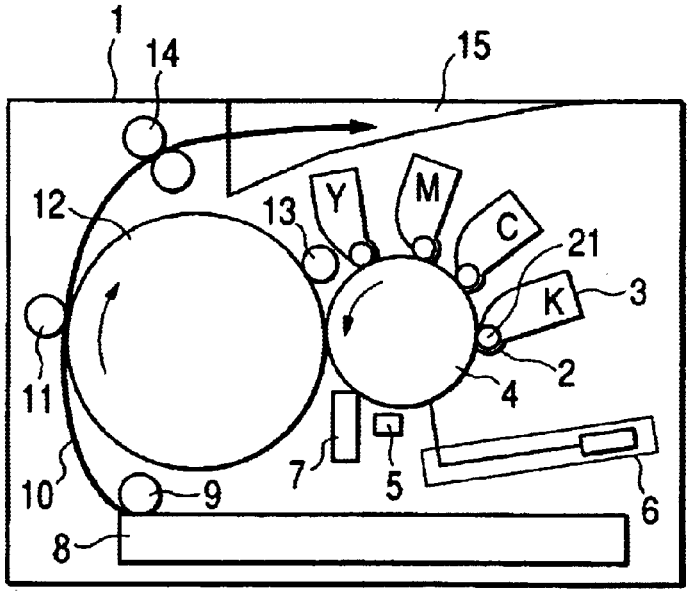
FIG. 1 is a schematic side view of a color image forming apparatus according to one embodiment the invention.

Preferred embodiments of the invention will now be described by reference to the accompanying drawings. However, the technical scope of the invention is not limited by the following embodiments. Incidentally, like elements are given like reference characters in the drawings and will be described with the reference characters.

As shown in FIG. 1, a color image forming apparatus 1 according to one embodiment of the invention comprises, like the related-art color image forming apparatus, developing devices 2, a photoreceptor 4, an charger 5, an exposer 6 and an intermediate transfer member 12. The color image forming apparatus employs a non-contact developing system with the four-color (YMCK) developing devices 2 and toner containers 3 that are disposed around the photoreceptor 4. The developing rollers 21 (toner carriers) of the respective developing devices 2 are fixedly positioned with a predetermined space apart from the surface of the photoreceptor 4 and never moved during the developing operation. Although the developing device 2 and the toner container 3 are shown such that both of them are integrally formed as shown in FIG. 1, these component elements may be provided separately from each other. Moreover, different-color developing devices may also be integrated into one body.

In the color image forming apparatus 1 thus arranged, the image formation is carried out through the following process. First, the rotating photoreceptor 4 is charged by the charger 5 and an electrostatic latent image in the first color is formed by the exposer 6. Then toner is transferred from the first-color developing roller 21 to the electrostatic latent image on the photoreceptor 4 and the first-color development is carried out. Further, the toner on the photoreceptor 4 is transferred to the intermediate transfer member 12, whereas the toner left on the photoreceptor 4 is removed by a cleaner 7.

Upon the termination of the process for the first-color development, a series of charging, exposure, developing and transferring steps is successively repeated for the remaining three colors, so that toner in all the four colors is transferred to the intermediate transfer member 12. At a transfer roller 11, the image thus transferred is again transferred onto paper 10 supplied by a pickup roller 9 from a paper feeding cassette 8 in synchronization with the intermediate transfer member 12. The image (toner) transferred onto the paper 10 is fixed by a fixer 14 before being sent to a discharging tray 15. In this case, the toner left on the intermediate transfer member 12 is removed by a cleaner 13.

The color image forming apparatus 1 of the invention is characterized by a method of applying a bias to the developing roller 21 in operation and the developing roller 21 not in operation when the development is carried out and so forth. The characteristics will now be described below.

In the color image forming apparatus 1, a bias whose absolute value is smaller than the absolute value of a developing bias is applied to the developing roller 21 not in operation.

Figure 2:
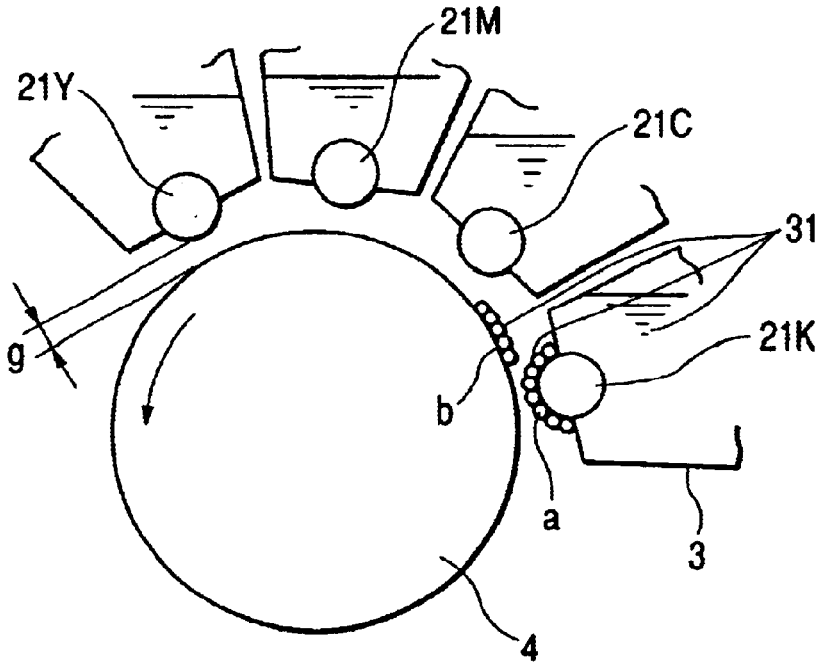
FIG. 2 is an enlarged side view of a photoreceptor and developing rollers in the color image forming apparatus.

As shown in FIG. 2, the developing rollers (21Y, 21M, 21C and 21K) for use in respectively developing four colors YMCK are fixedly spaced apart from the surface of the photoreceptor 4 with a gap "g". Further, the developing bias is applied from a developing bias generator (first bias generator 16 of FIG. 4) to the developing roller (e.g., 21K in the case of FIG. 2) for a color to be developed.

The developing bias results from superposing the AC component on the DC component, whereby a developing electric field is produced between the photoreceptor 4 and the developing roller 21K. More specifically, an electric field for urging toner 31 from the developing roller 21K toward the photoreceptor 4 while one peak value is taken out of one period of the AC component. The electrically charged toner 31 (a portion "a" of FIG. 2) transferred from the toner container 3 onto the developing roller 21K is transferred from the surface of the developing roller 21K to the surface of the photoreceptor 4 (a portion "b" of FIG. 2), whereby the electrostatic latent image on the photoreceptor 4 is developed with the toner.

Figure 3:
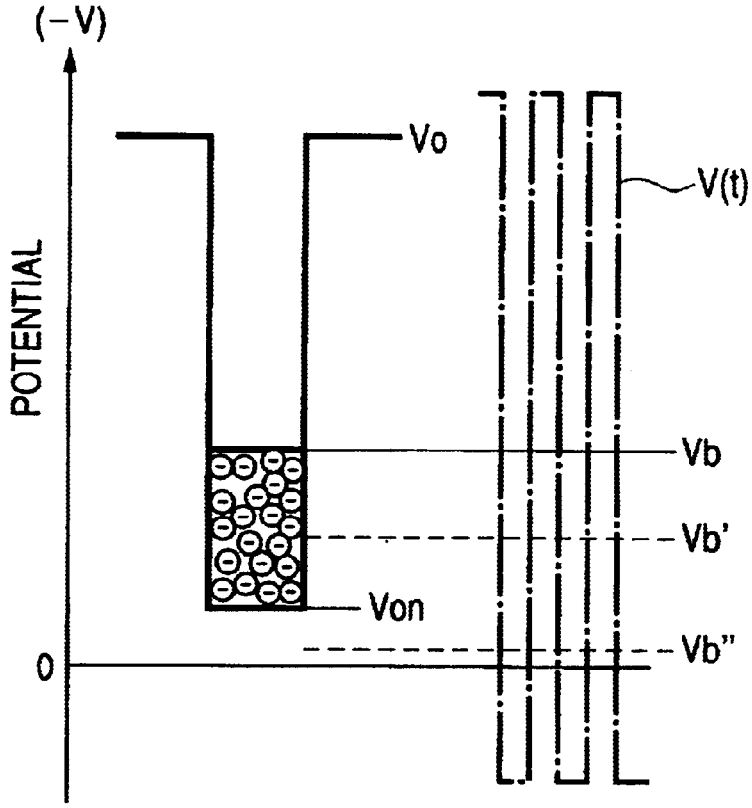
FIG. 3 is a diagram showing the relation between a potential at the surface of the photoreceptor and a developing bias.

In FIG. 3, Vo refers to a dark potential (of −600V, for example) after the photoreceptor is charged by the charger 5 and a portion not exposed by the exposer 6 to a light beam retains the dark potential. Further, Von refers to a light potential (of −70V, for example) and the potential at the portion exposed by the exposer 6 to the beam changes to the light potential. Thus, a well-shaped potential is formed at the surface of the photoreceptor 4 as shown in FIG. 3.

On the other hand, Vb refers to a potential (of −250V, for example) at the DC component of the developing bias applied to the developing roller 21 (e.g., 21K in FIG. 2) in operation. Therefore, the developing electric field for causing the toner 31 to be transferred is produced between the developing roller 21K and the exposed portion of the photoreceptor 4. Further, the AC component indicated by V(t) of FIG. 3 is superposed on the DC component whereby to cause the toner 31 to transfer from the developing roller 21K to the photoreceptor 4. Thus, regarding the developing color, the toner 31 is transferred to the exposed portion of the photoreceptor 4 and desired development is carried out.

Subsequently, three developing rollers 21 (21Y, 21M and 21C in FIG. 2) not in operation will be described. To these developing rollers 21, a predetermined bias having only the DC component is applied from a bias generator (second bias generator 17 of FIG. 4). The absolute value of this bias is smaller than the absolute value of the DC component of the developing bias. The potential is expressed by Vb' in FIG. 3.

When the potential at that value is given to the developing rollers 21Y, 21M and 21C not in operation, the potential Vb' at the developing rollers 21Y, 21M and 21C becomes, as is obvious from FIG. 3, lower than the potential Vb at the developed portion on the photoreceptor 4 and the force is not gathered to transfer the toner 31 from the developing roller 21, so that any other color hardly mixes with what is being developed to the extent that no problem occurs because the toner 31 is hardly transferred from the developing rollers 21Y, 21M and 21C. In this case, the position of Vb' in FIG. 3 is shown by way of example and as described above, the absolute value of Vb' is properly set at least smaller than the absolute value of Vb.

Regarding the developing roller 21 not in operation, its rotation is also stopped so as to restrain the toner 31 sticking to the developing roller 21 from scattering, whereby it is further ensured that unnecessary color is prevented from being introduced onto the photoreceptor 4.

Figure 4:
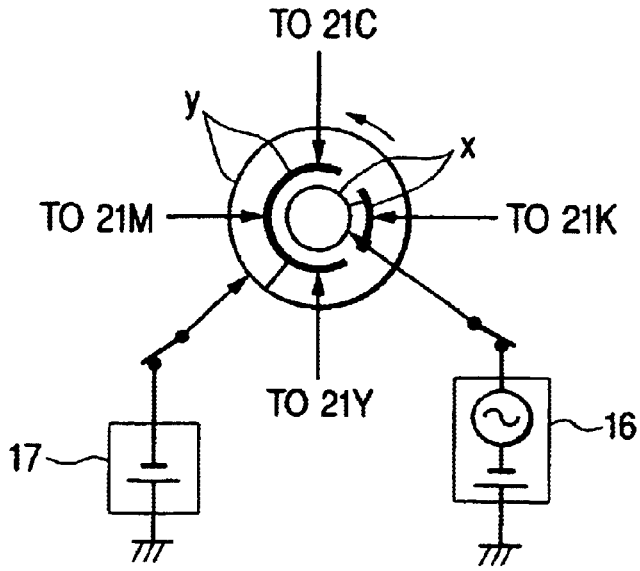
FIG. 4 is a schematic diagram illustrating an example of a circuit for supplying a bias to the developing rollers.

As shown in FIG. 4, a circuit for supplying a bias to the developing roller 21 comprises a first bias generator 16 and a second bias generator 17. The first bias generator 16 supplies the developing bias Vb to the developing roller 21 in operation, whereas the second bias generator 17 supplies the bias Vb' to the developing roller 21 not in operation. The condition shown in FIG. 4 is that the black color (K) is being developed and the first bias generator 16 is connected to the developing roller 21K via a portion x. On the other hand, the second bias generator 17 is connected to the developing rollers 21Y, 21M and 21C via a portion y.

Switching of colors to be developed is carried out by rotating the portions x and y integrally in the direction of an arrow in FIG. 4. When the portions x and y achieves a 90° turn in the condition above, for example, the first bias generator 16 is connected to the developing roller 21C and the developing bias is applied to the developing roller 21C, so that the cyan color is developed. As the switchable supply circuits are thus provided according to this embodiment of the invention, it is not needed to provide the first bias generator 16 and the second bias generator 17 to each developing roller 21 but the provision of only one set of them is sufficient.

Although a description has been given of the potential Vb at the DC component of the developing bias applied at the time of carrying out the development as the potential that remains constant regardless of color, the appropriate developing bias Vb may vary depending on the color. In such a case as this, it is needed to make the absolute value of the bias Vb' applied to the developing roller 21 not in operation smaller than the absolute value of the developing bias Vb having the smallest absolute value.

Incidentally, when the developing roller 21 in operation is not positioned on the most upstream side in the direction of rotation of the photoreceptor 4, that is, at the right-hand end (at the position of the developing roller 21K) in the case of FIG. 2, the developing roller 21 not in operation and positioned on a further upstream side than the developing roller 21 in operation exists and the developing operation is not performed yet on the surface of the photoreceptor 4 opposite to the developing roller 21. Thus, the potential at the exposed electrostatic latent image maintains the state of the light potential Von of FIG. 3. Assuming that as shown by Vb' of FIG. 3, the bias applied to the developing roller 21 positioned upstream has a value positioned above the light potential Von of FIG. 3, the toner 31 may transfer to the photoreceptor 4.

Accordingly, a mixture of colors is prevented effectively by applying to an upstream developing roller 21 a bias whose absolute value is smaller than the absolute value of the light potential Von as shown by Vb" of FIG. 3. It is therefore preferred to apply, to the upstream developing roller 21 positioned up the developing roller 21 in operation out of the developing rollers 21 not in operation, a bias whose absolute value is smaller than the absolute value of the light potential Von and also to apply to the downstream developing roller 21 a bias whose absolute value is smaller than the absolute value of the DC component Vb of the developing bias.

According to this embodiment of the invention, the second bias generator 17 is provided and the bias Vb' different from the potential Vb at the DC component of the developing bias is applied to the developing roller 21 not in operation. However, only the DC component of the developing bias may be applied to the developing roller 21 not in operation. In other words, the developing bias is applied to all the developing rollers 21 first and then only the AC component is cut when the development is not proceeding, whereby achieved is the effect of preventing color from the developing roller 21 not in operation from mixing with what is being developed even through the method of applying the developing bias thereto as the electric field for urging the toner 31 to transfer from the developing roller 21 due to the AC component is not formed.

As set forth above, in the color image forming apparatus 1 according to this embodiment of the invention, the toner 31 is substantially prevented from transferring from the developing roller 21 not in operation to the photoreceptor 4 and even though the gap "g" between the developing roller 21 and the photoreceptor 4 is decreased in order to attain clear development, unnecessary color mixture hardly occurs to the extent that no problem occurs.

Figure 5:
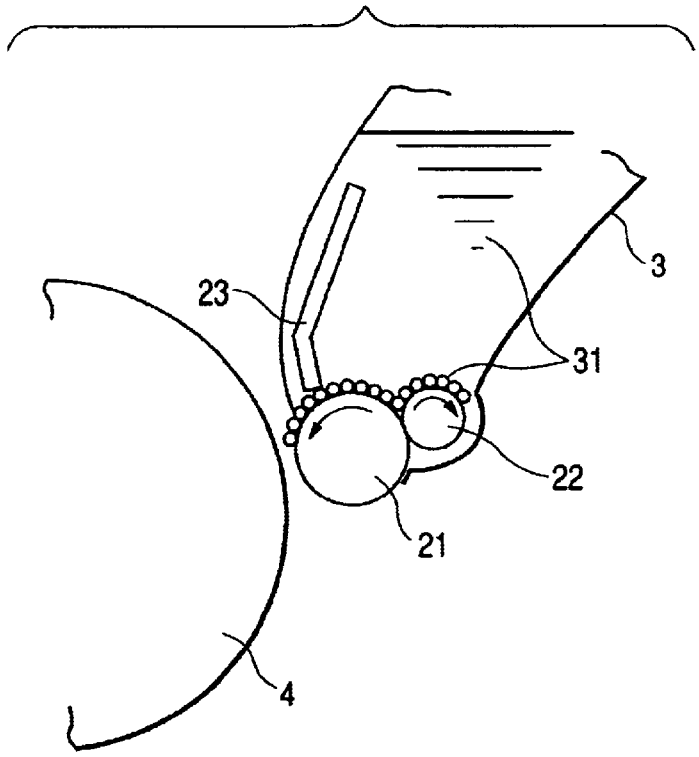
FIG. 5 is an enlarged side view of a developing device and a toner container.

The color image forming apparatus 1 according to this embodiment of the invention is also characterized in that the toner 31 in the toner container 3 is held over the developing roller 21 as shown in FIG. 5. A supply roller 22 is a roller for use in supplying toner in the toner container 3 to the developing roller 21 and a blade 23 is used for regulating the thickness of the toner 31 supplied to the photoreceptor 4 while the toner is sticking to the developing roller 21.

As the toner container 3 is shaped and disposed as shown in FIG. 5, the toner 31 never stays lower than the undersurface of the blade 23 and the toner 31 in the toner container 3 can totally be supplied to the photoreceptor 4 and used efficiently without waste. In this case, the shapes of the toner containers 3 are preferably one and the same.

Figure 6A:
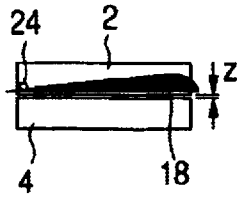
FIGS. 6A to 6C are diagrams showing the removal of the developing device.
Figure 6B:
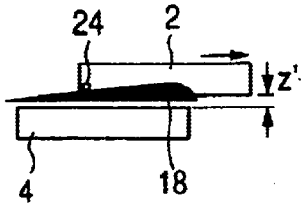
Figure 6C:
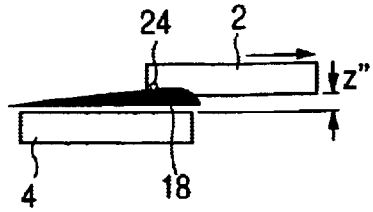

The color image forming apparatus 1 according to this embodiment of the invention is further characterized by a structure such that the space between the developing device 2 and the photoreceptor 4 is enlarged when the developing device 2 is pulled from its installing position in order to protect the photoreceptor 4 from being damaged when the developing device is removed and replaced as shown in FIGS. 6A to 6C. FIG. 6A shows a condition that the developing device 2 is completely installed. FIG. 6B shows a condition that that the developing device 2 starts to be moved from the installing position. FIG. 6C shows a condition that the developing device 2 is further moved from the installing position.

As shown in these figures, a slope guide member 18 is provided on the side of the developing device 2 around the photoreceptor 4 so as to ascend toward a direction that the developing device 2 is pulled from the installing position. A support member 24 in contact with the surface of the slope guide member 18 is formed on the side of the developing device 2.

When the developing device 2 is in the installing position as shown in FIG. 6A, the developing device 2 is kept close to the photoreceptor 4 as the support member 24 is at the lower position of the slope guide member 18 and the space "z" therebetween has a small value. When the developing device 2 is pulled out from the installing position (in a direction of an arrow in FIG. 6B), the position of the support member 24 rises along the slant surface of the slope guide member 18, whereby the position of the developing device 2 also rises. Consequently, the space z' with respect to the photoreceptor 4 grows larger than "z" shown in FIG. 6A. When the developing device 2 is pulled out to the right further as shown in FIG. 6C, the developing device 2 rises more according to the same principle and the space z" with respect to the photoreceptor 4 becomes larger still further.

Thus, the provision of the structure based on the principle illustrated in FIGS. 6A to 6C makes it possible to widen the space with respect to the photoreceptor 4 while the developing device 2 is being pulled out, and the developing device 2 required to be placed close to the photoreceptor 4 when it is installed because of the non-contact developing system can safely be removed and replaced without damaging the photoreceptor 4.

Figure 7:
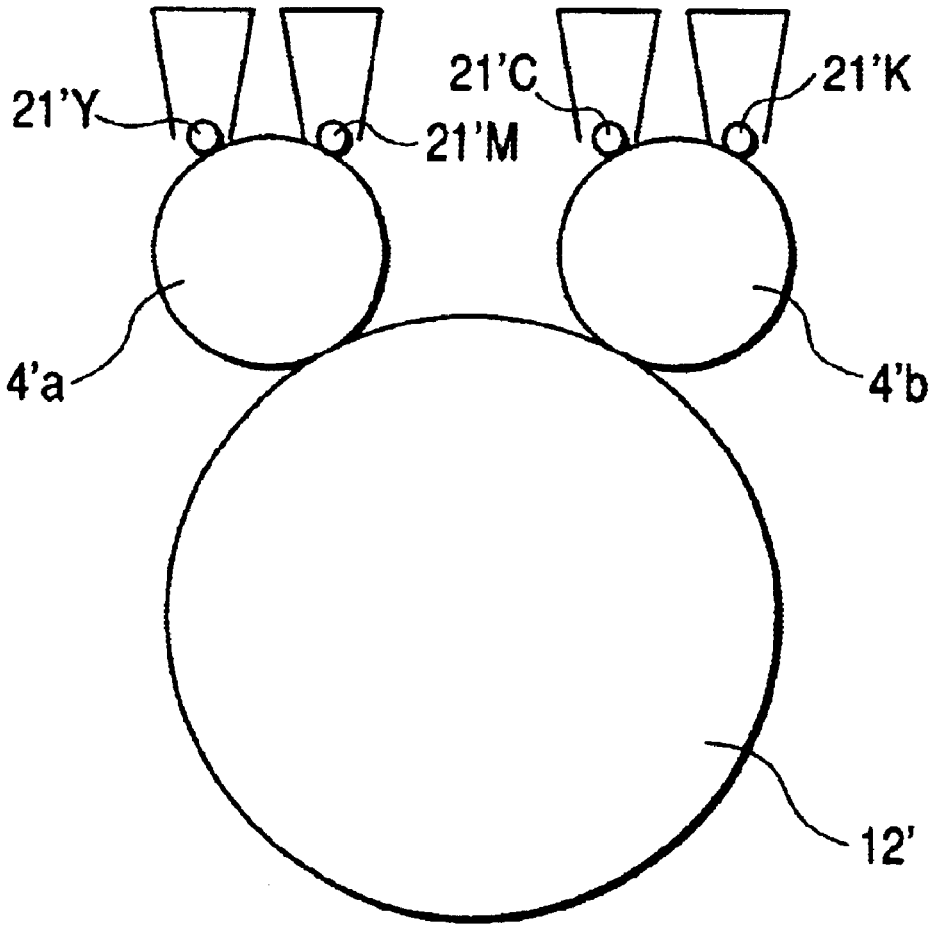
FIG. 7 is a schematic diagram of a color image forming apparatus according to another embodiment of the invention.

In the color image forming apparatus 1 according to the above embodiment of the invention, though there has been adopted a form of providing one photoreceptor 4 so that all the colors (four colors) are developed, the invention is also applicable to a case where an image forming apparatus has a plurality of photoreceptors whereby to have a plurality of colors developed on any one of the photoreceptors. FIG. 7 shows such an embodiment in which two colors images are developed on each of two photoreceptors.

In this figure, two photoreceptors 4'*a* and 4'*b* are provided with respect to one intermediate transfer member 12'. In order to carry out development on the non-contact developing system, two color developing rollers (21'Y and 21'M, and 21'C and 21'K) are disposed around the respective photoreceptors 4'*a* and 4'*b*. Although other component elements (not shown) of an image forming apparatus are similar to those shown in FIG. 1.

Although the process of forming an image according to this embodiment of the invention thus arranged is substantially the same as that in the color image forming apparatus according to the preceding embodiment of the invention but different in that parallel development is carried out on the two photoreceptors 4'*a* and 4'*b*. Consequently, according to this embodiment of the invention, one color and another color, that is, two colors altogether are substantially simultaneously developed on the respective photoreceptors 4'*a* and 4'*b*.

A bias is applied to the developing rollers not in operation similarly as described above on the respective photoreceptors 4'*a* and 4'*b*. In other words, a bias whose absolute value is smaller than the absolute value of a developing bias is applied to the remaining one developing roller not in operation on each of the photoreceptors 4'*a* and 4'*b*. In case where the developing roller 21'Y is in operation on the photoreceptor 4'*a* and the developing roller 21'C is also in operation on the photoreceptor 4'*b*, for example, a bias whose absolute value is smaller than the absolute value of the developing bias of the developing roller 21'Y is applied to the developing roller 21'M and similarly a bias whose absolute value is smaller than the absolute value of the developing bias of the developing roller 21'C is applied to the developing roller 21'K.

According to the embodiment as illustrated in FIG. 7, toner can be prevented from transferring from the developing roller not in operation to the photoreceptor 4' as in the case of the color image forming apparatus 1 according to the preceding embodiment thereof. As described above, further, as the parallel development of the two colors is carried out, the development of the whole color (four colors) is completed by causing each of the photoreceptors 4' to rotate twice, and this results in making the developing time shorter than that in the case of the color image forming apparatus according to the preceding embodiment, so that higher-speed image formation is made possible.

Although an arrangement has been made to carry out two-color development on each of the two photoreceptors in the embodiment illustrated in FIG. 7, the number of photoreceptors may be optional on condition that any one of the photoreceptors undertakes to develop a plurality of colors as described above.

As set forth above, a practical, high-quality image forming apparatus on a system of non-moving developing rollers can be realized by the color image forming apparatus. Therefore, a precision moving mechanism can be dispensed with and the time needed to move the developing roller can also be obviated, so that an attempt to increase the operating speed and to reduce the cost and size of the color image forming apparatus is accomplishable.

A range of protection according to the invention is not limited to the embodiment of the invention but extendable to the invention described in the scope of claims and its equivalents.

What is claimed is:

1. A color image forming apparatus, comprising:

a photoreceptor, on which a latent image is formed;

a plurality of toner carriers, each carries toner of a single color to be transferred onto the photoreceptor to make the latent image visible, each of the toner carriers fixed at a predetermined distance from a surface of the photoreceptor;

a first bias supplier, which supplies a first bias required to transfer the toner to the photoreceptor to one of the toner carriers which is subjected to a developing operation; and a second bias supplier, which supplies a second bias which is not enough to transfer the toner to the photoreceptor to the other toner carriers which are not subjected to the developing operation.

2. The color image forming apparatus as set forth in claim 1, wherein the first bias includes an AC component and a DC component, and the second bias is the DC component of the first bias.

3. The color image forming apparatus as set forth in claim 1, wherein the toner is stored in a toner container disposed above each of the toner carriers.

4. The color image forming apparatus as set forth in claim 1, further comprising:

a plurality of developing devices, each including at least one of the toner carriers, each of the developing devices disposed at an installing position and movable from the installing position in a first direction; and a guide member, which guides each developing device such that a distance between the surface of the photoreceptor and each toner carrier is enlarged in a second direction substantially perpendicular to the first direction, in accordance with a movement of each developing device in the first direction.

5. The color image forming apparatus as set forth in claim 1, wherein the photoreceptor is at least one of a plurality of photoreceptors provided in the apparatus.

6. A color image forming apparatus, comprising:

a photoreceptor, on which a latent image is formed;

a plurality of toner carriers, each carries toner of a single color to be transferred onto the photoreceptor to make the latent image visible, each of the toner carriers fixed at a predetermined distance from a surface of the photoreceptor;

a first bias supplier, which supplies a first bias having at least one first absolute value required to transfer the toner to the photoreceptor to one of the toner carriers which is subjected to a developing operation; and a second bias supplier, which supplies a second bias having a second absolute value less than the first absolute value to the other toner carriers which are not subjected to the developing operation.

7. The color image forming apparatus as set forth in claim 6, wherein the first bias includes an AC component and a DC component having the first absolute value.

8. The color image forming apparatus as set forth in claim 6, wherein a plurality of first absolute values are provided according to colors of the toner.

9. The color image forming apparatus as set forth in claim 6, wherein the toner is stored in a toner container disposed above each of the toner carriers.

10. The color image forming apparatus as set forth in claim 6, further comprising:

a plurality of developing devices, each including at least one of the toner carriers, each of the developing devices disposed at an installing position and movable from the installing position in a first direction; and a guide member, which guides each developing device such that a distance between the surface of the photoreceptor and each toner carrier is enlarged in a second direction substantially perpendicular to the first direction, in accordance with a movement of each developing device in the first direction.

11. The color image forming apparatus as set forth in claim 6, wherein the photoreceptor is at least one of a plurality of photoreceptors provided in the apparatus.

* * * * *